US009366032B2

(12) United States Patent
Xie et al.

(10) Patent No.: US 9,366,032 B2
(45) Date of Patent: Jun. 14, 2016

(54) THREAD ROLLING FIXED LENGTH SPIRAL RIB STEEL WIRE

(71) Applicant: Tieqiao Xie, Tianjin (CN)

(72) Inventors: Tieqiao Xie, Tianjin (CN); Zhian Xie, Tianjin (CN); Chongjian Yan, Tianjin (CN); Tieling Ai, Tianjin (CN); Yiwen Zhang, Tianjin (CN)

(73) Assignee: Tieqiao Xie, Tianjin (CN)

( * ) Notice: Subject to any disclaimer, the term of this patent is extended or adjusted under 35 U.S.C. 154(b) by 312 days.

(21) Appl. No.: 14/026,476

(22) Filed: Sep. 13, 2013

(65) Prior Publication Data

US 2015/0079418 A1 Mar. 19, 2015

(51) Int. Cl.
*E04C 5/03* (2006.01)
*E04C 5/08* (2006.01)

(52) U.S. Cl.
CPC ... *E04C 5/08* (2013.01); *E04C 5/03* (2013.01); *Y10T 428/12389* (2015.01)

(58) Field of Classification Search
CPC ..... E04C 5/03
USPC ..... 52/851, 853, 857
See application file for complete search history.

(56) References Cited

PUBLICATIONS

Archived Internet Page https://web.archive.org/web/20120212013058/http://www.reinforcingsteelbar.com/reinforcingbar/spiral-pc-wire.html dated Feb. 12, 2012.*
Archived Internet Page—https://web.archive.org/web/20120212013058/http://www.pcstrand.net/prestressedconcretesteelwire.html dated Jun. 21, 2011.*

* cited by examiner

*Primary Examiner* — Adam Krupicka
(74) *Attorney, Agent, or Firm* — Flener IP Law, LLC; Zareefa B. Flener

(57) ABSTRACT

The present invention discloses a thread rolling fixed length, spiral rib steel wire used in prestressed concrete sleepers and track plates, including a 2.5 m long spiral rib prestressed steel wire, where both ends of said steel wire have continuous external thread section whose length is 30±2 mm, wherein, the surface of said steel wire has four parallel winding spiral ribs whose cross section is trapezoidal and lead is 41~55 mm, the nominal diameter of said steel wire is 9.5 mm, 10.0 mm, or 10.5 mm, and the elastic-limit of said steel wire is larger than 1200 N/mm$^2$.

7 Claims, 2 Drawing Sheets

A–A

A–A

THREAD ROLLING FIXED LENGTH SPIRAL RIB STEEL WIRE

FIELD OF THE INVENTION

The embodiments of the present invention are related to a prestressed steel wire, especially to a thread rolling fixed length spiral rib steel wire.

BACKGROUND OF THE INVENTION

The prestressed steel wire is usually sold to enterprises in the unit of plate. According to the specific requirements, the enterprises cut the steel wire to length, perform thread rolling on both ends, perform stretch-drawing in the concrete product mold, compact the steel wire by pouring concrete, and make the steel wire into prestressed concrete products after curing in oxygen streaming. This method causes the inconvenience of end user, due to the on-site measurement, on-site cutting, and on-site thread rolling required. The complex condition of the construction site cannot ensure the precision of the cutting size, which affects the working efficiency. Therefore, a new scheme is required to resolve the problem of low on-site cutting precision.

SUMMARY OF THE INVENTION

One objective of the embodiments of the present invention is to provide a thread rolling fixed length spiral rib steel wire used in prestressed concrete sleepers and track plates, which is simple-construction, secure, and reliable.

In one embodiment of the present invention, a thread rolling fixed length spiral rib steel wire used in prestressed concrete sleepers and track plates is provided, including a 2.5 m long spiral rib prestressed steel wire, where both ends of said steel wire having continuous external thread section whose length is 30±2 mm, wherein, the surface of said steel wire has four parallel winding spiral ribs whose cross section is trapezoidal and lead is 41-55 mm, the nominal diameter of said steel wire has three kinds of specifications, including 9.5 mm, 10.0 mm, and 10.5 mm, and the elastic limit of said steel wire is larger than 1200 N/mm$^2$.

Preferably, when the nominal diameter of said steel wire is 9.5 mm, the base diameter of said steel, wire is 9.3 mm±0.05 mm, the outer contour diameter of said steel wire is 10.10 mm±0.1 mm, the top width of the rib is 1.6-2.0 mm, the bottom width of the rib is 2.5-2.9 mm, and the height of the rib is 0.3-0.5 mm.

Preferably, when the nominal diameter of said steel wire is 10.0 mm, the base diameter of said steel wire is 9.75 mm±0.05 mm, the outer contour diameter of said steel wire is 10.60 mm±0.1 mm, the lead of the spiral rib is 42-51 mm, the top width of the rib is 1.8-2.2 mm, the bottom width of the rib is 2.6-3.1 mm, and the height of the rib is 0.3-0.5 mm.

Preferably, when the nominal diameter of said steel wire is 10.5 mm, the base diameter of said steel wire is 10.3 mm±0.05 mm, the outer contour diameter of said steel wire is 11.10 mm±0.1 mm, the lead of the spiral rib is 49-55 mm, the top width of the rib is 2.0-2.4 mm, the bottom width of the rib is 2.9-3.3 mm, and the height of the rib is 0.4-0.5 mm.

Preferably, the specification of the external thread on both ends of said steel wire is M10.25×1.5, the outer contour diameter of the external thread is 10.17-10.37 mm, the pitch diameter of the external thread is 9.20-9.40 mm, the bottom diameter of the external thread is 8.62-8.78 mm, and the bottom, of angle the external thread is 60°.

Preferably, the specification of the external thread on both ends of said steel wire is M10.65×1.5, the outer contour diameter of the external thread is 10.55-10.75 mm, the pitch diameter of the external thread is 9.70-9.80 mm, the bottom diameter of the external thread is 8.80-9.00 mm, and the bottom angle of the external thread is 60°.

Preferably, the specification of the external thread on both ends of said steel wire is M11.25×1.5, the outer contour diameter of the external thread is 11.17-11.37 mm, the pitch diameter of the external thread is 10.20-10.40 mm, the bottom diameter of the external thread is 9.62-9.78 mm, and the bottom angle of the external thread is 60°.

DETAILED DESCRIPTION OF THE INVENTION

The embodiments of the present invention are described more folly hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as systems, methods or devices. The following detailed description should not to be taken in a limiting sense.

Throughout the specification and claims, the following terms take the meanings explicitly associated herein, unless the context clearly dictates otherwise. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on." Further reference may be made to an embodiment where a component is implemented and multiple like or identical components are implemented.

While the embodiments make reference to certain events this is not intended to be a limitation of the embodiments of the present invention and such is equally applicable to any event where goods or services are offered to a consumer.

The present invention is further described in detail hereinafter with reference to the accompanying drawings as well as embodiments so as to make the objective, technical scheme and merits thereof more apparent.

Figure 1:
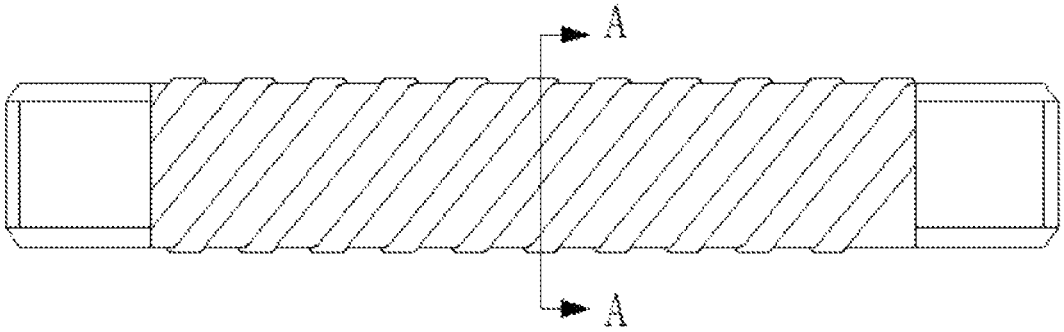
FIG. 1 illustrates the structure of a prestressed steel wire in one embodiment of the present invention.
Figure 2:
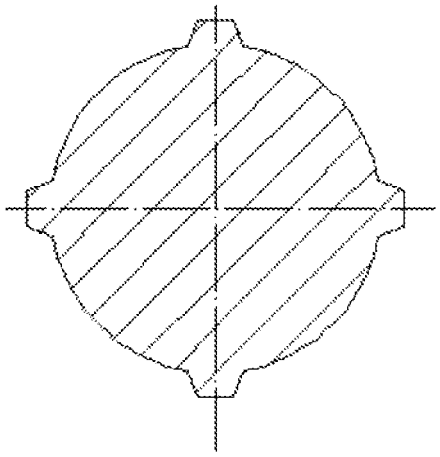
FIG. 2 illustrates the cutaway view of FIG. 1 along A-A line.

FIG. 1 illustrates the structure of a prestressed steel wire in one embodiment of the present invention. FIG. 1 shows a spiral rib prestressed steel wire, of which both ends have continuous external thread section. The surface of said steel wire has four parallel winding spiral ribs. The four ribs forms the cross bulged around the base circle on the cross section of the steel wire. The ribs are horizontally and vertically symmetrical, as shown in FIG. 2, and the cross section of the spiral rib is trapezoidal.

The spiral rib is integrally formed, which corresponds to the sunk angled trapezoidal groove in the wire drawing mold. The spiral rib made by the mold has a horizontally and vertically symmetrical cross at the both ends.

In one embodiment, the spiral rib prestressed steel wire is 2.5 m long. the length of each external thread section is 30±2 mm, and the lead of the spiral ribs is 41-55 mm, and there are three kinds of sizes, for the nominal diameter of said steel wire, including 9.5 mm, 10.0 mm, and 10.5 mm, the elastic limit of said steel wire is larger than 1200 N/mm$^2$.

Embodiment 1

Figure 3:
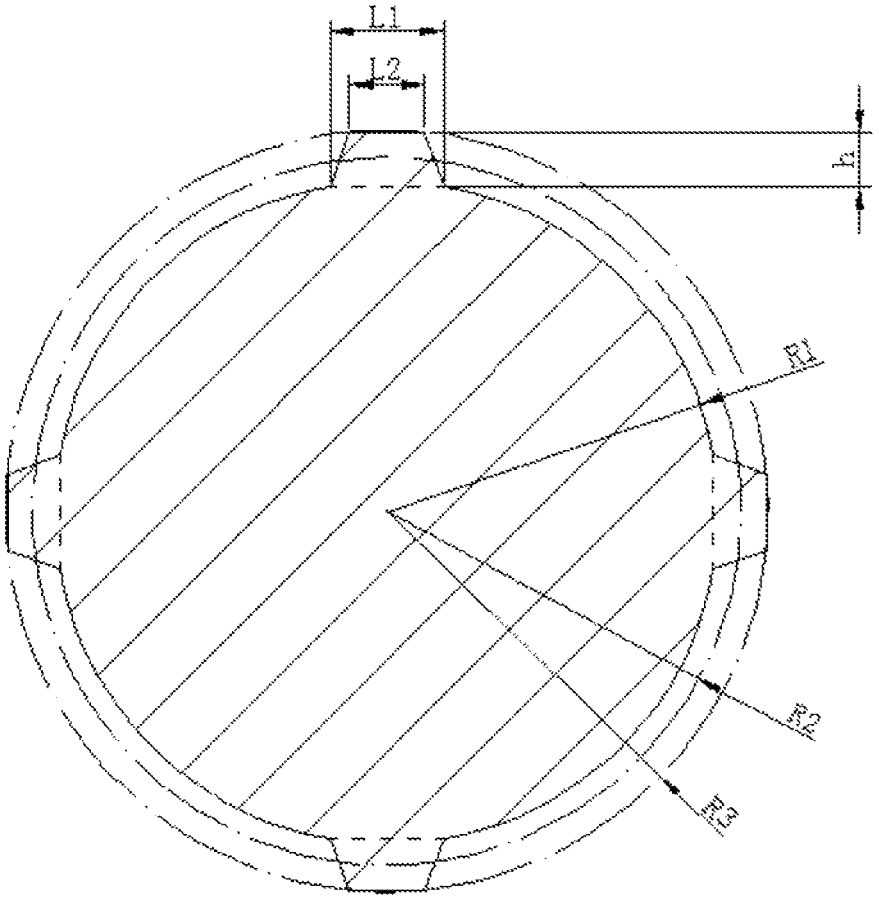
FIG. 3 illustrates the enlargement of FIG. 2.

As shown in FIG. 1 and FIG. 2, a thread rolling fixed length spiral rib steel wire used in prestressed concrete sleepers and track plates in an embodiment of the present invention, includes a 2.5 m long spiral rib prestressed steel wire, where both ends of said steel wire have continuousexternal thread section whose length is 30±2 mm, the surface of said steel wire has four parallel winding spiral ribs whose cross section is trapezoidal and lead is 41-55 mm, the nominal diameter of said steel wire (refers to R2 as shown in FIG. 3) is 9.5 mm, and the elastic limit of said steel wire is larger than 1200 N/mm$^2$.

The four ribs forms the cross bulged around the base circle on the cross section of the steel wire. The ribs are horizontally and vertically symmetrical. The steel wire bulges the rib, which corresponds to the sunk angled trapezoidal groove in the wire drawing mold. The spiral rib is a horizontally and vertically symmetrical cross from the workspace to die export end face in the mold, which facilitates the control of the precision of the molding process. The spiral mold with four ribs has the minimum working loss, which efficiently improves the production capacity of spiral lib steel wire and saves the raw material consumption.

The lead is within the range of 41-55 mm. When the concrete strength is 50 N/mm$^2$, the transfer length of the prestress is 285 mm-300 mm, which forms the ideal transition region before the sleepers or track plates reach the designed prestress.

The elastic limit Rp0.01 should be larger than 1200 N/mm$^2$. Hence, the steel wire completely works in the elastic deformation area, which will prolong the service life of sleepers or track plates, and make the new-type sleepers or track plates exhibit excellent static load and dynamic load fatigue and long-term service effect.

The length of the external thread is 30±2 mm, which satisfies both the processing requirement of the fixed end and the tensioning end, and the purpose of strong and durable anchoring force.

The base diameter of said steel wire (refers to R1 as shown in FIG. 3) is 9.3 mm±0.05 mm, the outer contour diameter of said steel wire (refers to R3 as shown in FIG. 3) is 10.10 mm±0.1 mm, the lead of the spiral rib is 41-51 mm, the top width of the rib (refers to L1 as shown in FIG. 3) is 1.6-2.0 mm, the bottom width of the rib (refers to L2 as shown in FIG. 3) is 2.5-2.9 mm, and the height of the rib (refers to h as shown in FIG. 3) is 0.3-0.5 mm. This ensures enough ability to cohere with concrete. The spiral rib sleeper steel wire is compacted by pouring concrete after stretch-drawing. The cured concrete fills the spiral rib slot, which forms four spiral cohesive anchor concrete systems, obviates the possibility of the longitudinal slipping of steel wire, and ensures the prestress can be uniformly formed on any cross section of sleepers or track plates.

The size of the external thread on both ends of said steel wire is M10.25×1.5, the outer contour diameter of the external thread is 10.17-10.37 mm, the pitch diameter of the external thread is 9.20-9.40 mm, the bottom diameter of the external thread is 8.62-8.78 mm, and the bottom angle of the external thread is 60°. This thread size makes that its tensile strength together with nut is larger than 90% of the nominal tensile strength.

Embodiment 2

As shown in FIG. 1 and FIG. 2, a thread rolling fixed length spiral rib steel wire used in prestressed concrete sleepers and track plates in another embodiment of the present invention, includes a 2.5 m long spiral rib prestressed steel wire, where both ends of said steel wire have continuous external thread section whose length is 30±2 mm, the surface of said steel wire has four parallel winding spiral ribs whose cross section is trapezoidal and lead is 41-55 mm, the nominal diameter of said steel wire is 10.0 mm, and the elastic limit of said steel wire is larger than 1200 N/mm$^2$.

The base diameter of said steel wire (refers to R1 as shown in FIG. 3) is 9.75 mm±0.05 mm, the outer contour diameter of said steel wire (refers to R3 as shown in FIG. 3) is 10.60 mm±0.1 mm, the lead of the spiral rib is 42-51 mm, the top width of the rib (refers to L1 as shown in FIG. 3) is 1.8-2.2 mm, the bottom width of the rib (refers to L2 as shown in FIG. 3) is 2.6-3.1 mm, and the height of the rib (refers to h as shown in FIG. 3) is 0.3-0.5 mm.

The size of the external thread on both ends of said steel wire is M10.65×1.5, the outer contour diameter of the external thread is 10.55-10.75 mm, the pitch diameter of the external thread is 9.70-9.80 mm, the bottom diameter of the external thread is 8.80-9.00 mm, and the bottom angle is 60°.

All the above sizes and dimensions can achieve the effector satisfy the corresponding parameter requirement mentioned in Embodiment 1.

Embodiment 3

As shown in FIG. 1 and FIG. 2, a thread rolling fixed length spiral rib steel wire used in prestressed concrete sleepers and track plates in another embodiment of the present invention, includes a 2.5 m long spiral rib prestressed steel wire, where both ends of said steel wire have continuous external thread section whose length is 30±2 mm, the surface of said steel wire has four parallel winding spiral ribs whose cross section is trapezoidal and lead is 41-55 mm, the nominal diameter of said steel wire is 10.5 mm, and the elastic limit of said steel wire is larger than 1200 N/mm$^2$.

The base diameter of said steel wire (refers to R1 as shown in FIG. 3) is 10.3 mm±0.05 mm, the outer contour diameter of said steel wire (refers to R3 as shown in FIG. 3) is 11.10 mm±0.1 mm, the lead of the spiral rib is 49-55 mm, the top width of the rib (refers to L1 as shown in FIG. 3) is 2.0-2.4 mm, the bottom width of the rib (refers to L2 as shown in FIG. 3) is 2.9-3.3 mm, and the height of the rib (refers to h as shown in FIG. 3) is 0.4-0.5 mm.

The size of the external thread on both ends of said steel wire is M11.25×1.5, the outer contour diameter of the external thread is 11.17-11.37 mm, the pitch diameter of the external thread is 10.20-10.40 mm, the bottom diameter of the external thread is 9.62-9.78 mm, and the bottom angle is 60°.

All the above sizes and dimensions can achieve the effector satisfy the corresponding parameter requirement mentioned in Embodiment 1.

By using the scheme, after the steel wire is produced, the steel wire is directly cut to the specified size and the thread rolling is performed on the steel wire to form the thread rolling fixed length spiral rib steel wire. When applying thread rolling fixed length spiral rib steel wire to the railway sleepers or track plates, since the size of railway sleepers or track plates is fixed, the end user then can directly apply the steel wire formed to the mold on the site, use the nut to fasten the steel wire after stretch-drawing, which improves the working efficiency, ensures the precision of the size of the steel wire, and hence efficiently improves tire inherent qualify of railway sleepers and track plates.

By setting the number of spiral ribs is as four, it is easy to control the precision of the wire drawing and molding process. Furthermore, the rotary torque of the mold formed by four ribs mostly balance and is stable. The spiral mold with four ribs has the minimum working loss, which efficiently improves the production capacity of spiral lib steel wire and saves the raw material consumption.

The spiral rib steel wire used in railway sleeper has three kinds of sizes, where the nominal rib heights are all not less than 0.4 mm, which ensures enough ability to cohere with concrete. The rib is trapezoidal, and the top width and bottom width of the rib is explicitly specified. The spiral rib sleeper steel wire is compacted by pouring concrete after stretch-drawing. The cured concrete fills the spiral rib slot, which forms four spiral cohesive anchor concrete systems, obviates the possibility of the longitudinal slipping of steel wire, and ensures the prestress can be uniformly formed on any cross section of sleepers or track plates.

The lead of spiral rib is within the range of 41 mm-55 mm, which make the transfer length of the prestress is 285 mm-300 mm, when the prestressed sleepers is made by the steel wire specified in the three sizes, and the concrete strength is 50 $N/mm^2$, which forms the ideal transition region before the sleepers or track plates reaching the designed prestress.

The elastic limit of the spiral rib steel wire specified in the three sizes used in railway sleepers is larger than 1200 $N/mm^2$. Hence, the steel wire completely works in elastic deformation area, which will prolong the service life of sleepers or track plates, and make the new-type sleepers or track plates exhibit excellent static load and dynamic load fatigue and long-term service effect.

The design of the external thread ensures that the tensile strength together with nut is larger than 90% of the nominal tensile strength. The thread length is optimized to 30±2 mm, which satisfies both the processing requirement of the fixed end and the tensioning end, and the purpose of strong and durable anchoring force.

It should be understood that all of embodiments disclosed in the present invention can be combined or separated, which still should be considered within the scope of the present invention.

It should be understood that various changes and modifications to the presently preferred, embodiments described herein will be apparent to those skilled in the art. Such changes and modifications may be made without departing from the spirit and scope of the present invention and without diminishing its attendant, advantages. It is, therefore, intended that such changes and modifications be covered by the appended claims.

The invention claimed is:

1. A thread rolling fixed length spiral rib steel wire, comprising: a 2.5 m long spiral rib prestressed steel wire, where both ends of said steel wire respectively having a continuous thread section, wherein the continuous thread section applies external thread and occupies 30±2 mm of said steel wire; wherein, the surface of said steel wire between the two continuous thread sections has four parallel winding spiral ribs whose cross section is trapezoidal and lead is 41-55 mm, the nominal diameter of said steel wire is 9.5 mm, 10.0 mm, or 10.5 mm, and the elastic limit of said steel wire is larger than 1200 $N/mm^2$;

wherein the four spiral ribs form a horizontally and vertically symmetrical cross bulged around a base circle on a cross section of the steel wire.

2. The thread rolling fixed length spiral rib steel wire of claim 1, wherein, when the nominal diameter of said steel wire is 9.5 mm, the base diameter of said steel wire is 9.3 mm±0.05 mm, the outer contour diameter of said steel wire is 10.10 mm±0.1 mm, the top width of the rib is 1.6-2.0 mm, the bottom width of the rib is 2.5-2.9 mm, and the height of the rib is 0.3-0.5 mm.

3. The thread rolling fixed length spiral rib steel wire of claim 1, wherein, when the nominal diameter of said steel wire is 10.0 mm, the base diameter of said steel wire is 9.75 mm±0.05 mm, the outer contour diameter of said steel wire is 10.60 mm±0.1 mm, the lead of the spiral rib is 42-51 mm, the top width of the rib is 1.8-2.2 mm, the bottom width of the rib is 2.6-3.1 mm, and the height of the rib is 0.3-0.5 mm.

4. The thread rolling fixed length spiral rib steel wire of claim 1, wherein, when the nominal diameter of said steel wire is 10.5 mm, the base diameter of said steel wire is 10.3 mm±0.05 mm, the outer contour diameter of said steel wire is 11.10 mm±0.1 mm, the lead of the spiral rib is 49-55 mm, the top width of the rib is 2.0-2.4 mm, the bottom width of the rib is 2.9-3.3 mm, and the height of the rib is 0.4-0.5 mm.

5. The thread rolling fixed length spiral rib steel wire of claim 2, wherein, the size of the external thread on both ends of said steel wire is M10.25×1.5, the outer contour diameter of the external thread is 10.17-10.37 mm, the pitch diameter of the external thread is 9.20-9.40 mm, the bottom diameter of the external thread is 8.62-8.78 mm, and the bottom of angle the external thread is 60°.

6. The thread rolling fixed length spiral rib steel wire of claim 3, wherein, the size of the external thread on both ends of said steel wire is M10.65×1.5, the outer contour diameter of the external thread is 10.55-10.75 mm, the pitch diameter of the external thread is 9.70-9.80 mm, the bottom diameter of the external thread is 8.80-9.00 mm, and the bottom angle of the external thread is 60°.

7. The thread rolling fixed length spiral rib steel wire of claim 4, wherein, the size of the external thread on both ends of said steel wire is M11.25×1.5, the outer contour diameter of the external thread is 11.17-11.37 mm, the pitch diameter of the external thread is 10.20-10.40 mm, the bottom diameter of the external thread is 9.62-9.78 mm, and the bottom angle of the external thread is 60°.

* * * * *